United States Patent [19]

Samelson

[11] Patent Number: 4,563,785

[45] Date of Patent: Jan. 14, 1986

[54] CUSHION WITH SIMULATED BUTTON TUFT AND METHOD FOR MANUFACTURING SAME

[75] Inventor: Samuel Samelson, Goldsboro, N.C.

[73] Assignee: EX-CELL Home Fashions, New York, N.Y.

[21] Appl. No.: 620,400

[22] Filed: Apr. 5, 1985

[51] Int. Cl.[4] ..... A47C 27/14; D05C 15/00

[52] U.S. Cl. ..... 5/472; 5/471; 112/262.3; 112/266.2; 428/102; 428/172

[58] Field of Search ..... 428/102, 172; 5/472, 5/408, 448, 481, 490, 434, 436, 471; 112/402, 262.3, 266.2; 156/93

[56] References Cited

U.S. PATENT DOCUMENTS 4,040,881 8/1977 Wallace ..... 5/472

FOREIGN PATENT DOCUMENTS 1068419 12/1979 Canada ..... 5/408

23881 1/1896 United Kingdom ..... 5/472

*Primary Examiner*—Paul J. Thibodeau

*Attorney, Agent, or Firm*—James & Franklin

[57] ABSTRACT

A solid compressible foam body is enclosed within a cover of flexible material. A plurality of recessed areas are formed along the surface of the cushion by compressing the foam body in each area and applying closed stitch patterns defining a circular section. The stitches in each pattern pass through the foam body and the cover material situated adjacent opposite surfaces thereof. The stitches maintain the foam body within the stitched areas in a permanently compressed state. The recessed areas are uniformly spaced to create a simulated button tufting effect.

6 Claims, 4 Drawing Figures

CUSHION WITH SIMULATED BUTTON TUFT AND METHOD FOR MANUFACTURING SAME

The present invention relates to cushions or similar articles and a method for manufacturing same and, more particularly, to a cushion or similar article with simulated button tufting and a method for manufacturing same.

Articles such as cushions, pillows, and the like are made by enclosing a fibrous filler material of various types between sheets of fabric material which is stitched along the periphery to form a cover. In order to aesthetically enhance the cushion or pillow and to prevent the filler material from distributing unevenly, such articles are often tufted.

Tufts consist of one or more stitches which are drawn tightly through the article to keep the cover material on each side of the article in closer proximity than in other portions of the article. A button or the like is often fastened on one or both sides of the tuft. Normally, the tufts are distributed in a uniform pattern across the surface of the article.

Recently, many articles of this type have been manufactured with a block of compressible foam as a substitute for conventional fibrous filler material. Because of the nature of the foam block, it cannot move within the cover to become unevenly distributed and, thus, need not be anchored by tufts in the same way as conventional filler material.

However, in some instances, it is desirable, for aesthetic reasons, to employ tufts even when the article is formed from a foam block. It is further desirable that a button effect be achieved at each tuft. While the button effect could be achieved by attaching a real button to each tuft, to do so would substantially increase the manufacturing costs, a result which is to be avoided.

With foam filled articles, the tufting stitching may pass directly through the foam block or openings may be formed in the foam block at positions aligned with the points where the tufting stitches will be placed. This latter method creates manufacturing difficulties which contribute to increases in manufacturing cost. An additional manufacturing step is required to drill the openings in the correct positions in the foam body. Moreover, certain alignment problems must be overcome to insure that the tufting stitching correctly aligns with the openings in the foam block.

It is, therefore, a prime object of the present invention to provide a cushion with simulated button tufting and a method for manufacturing same wherein simulated buttons formed from stitch patterns are utilized to produce a simulated tufted effect.

It is another object of the present invention to provide a cushion with simulated button tufting and a method for manufacturing same wherein a solid foam block is utilized and the stitching passes directly through the body thereof and maintains same in a compressed condition.

It is another object of the present invention to provide a cushion with simulated button tufting and a method for manufacturing same which has a simplified structure.

It is another object of the present invention to provide a cushion with simulated button tufting and a method for manufacturing same wherein the cushion can be manufactured relatively inexpensively employing a simplified manufacturing process.

To these and to such other objects which may hereinafter appear, the present invention relates to a cushion with simulated button tufting and a method for manufacturing same, as described in detail in the following specification and recited in the annexed claims, taken together with the accompanying drawings, wherein like numerals refer to like parts, and in which:

Figure 1:
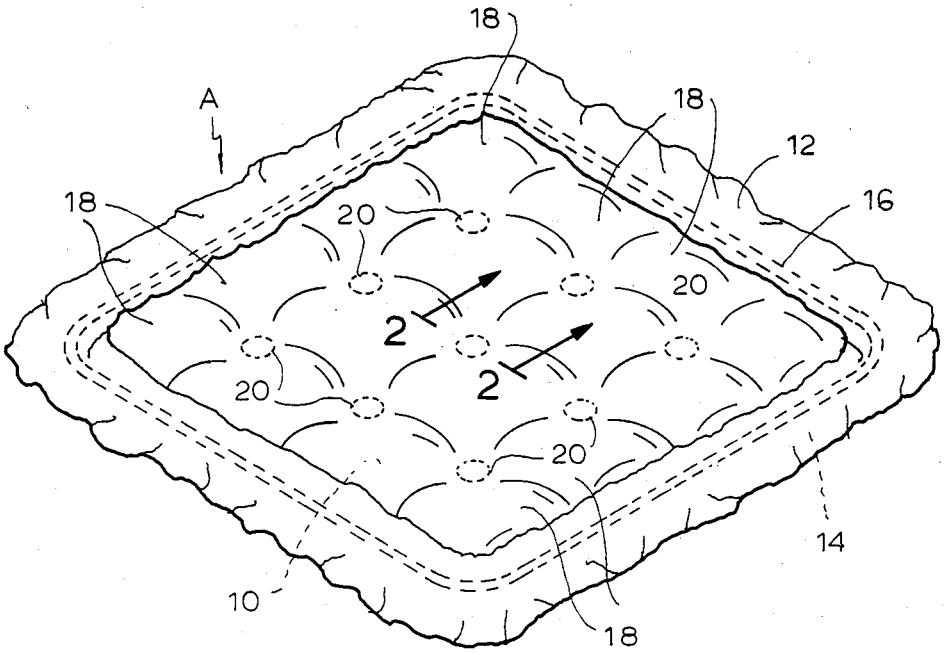
FIG. 1 is an isometric view of the cushion with simulated button tufting of the present invention.
Figure 2:
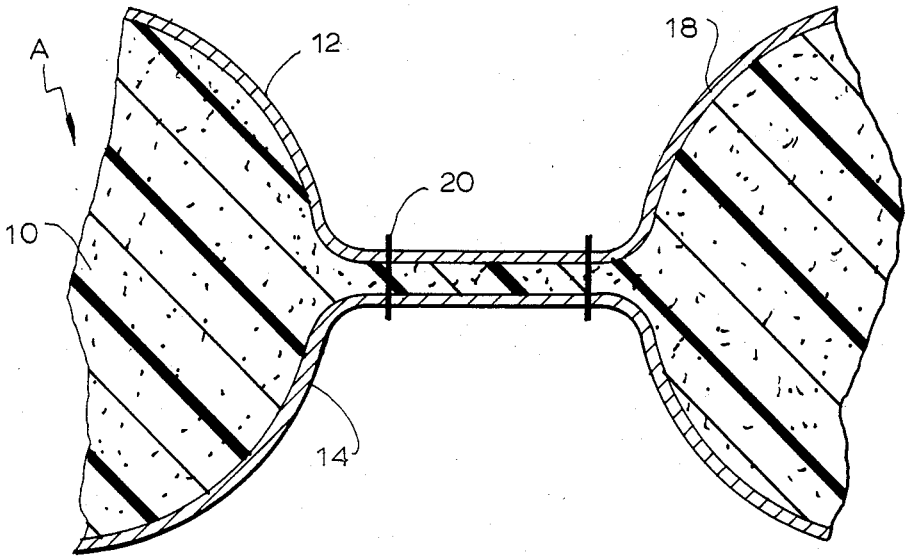
FIG. 2 is a fragmentary cross-sectional view taken along line 2—2 of FIG. 1.

As best seen in FIGS. 1 and 2, the cushion, generally designated A, of the present invention comprises a solid body 10 composed of compressible foam rubber or the like. As used in the following specification, the term "solid" is meant to indicate that body 10 is filled beneath the surface, that is, is not hollow, and has no openings other than the normal air spaces characteristic of a foam composition. Surrounding body 10 are first and second sheets of cover material 12, 14 which can be composed of any suitable fabric material. Cover sheets 12 and 14 are stitched together around the periphery of the cushion by stitches 16 such that the cover completely encloses foam body 10.

Evenly spaced along the surface of the cushion are a plurality of recessed portions 18. Each of the recessed areas 18 includes a closed, preferably circular stitch pattern 20 which simulates a button. As seen in FIG. 2, the circular stitch pattern 20 passes through cover sheet 12, a portion of foam body, and cover sheet 14. Once applied, the circular stitch pattern maintains the portion of foam body 10 situated therein in a permanently compressed state.

Figure 3:
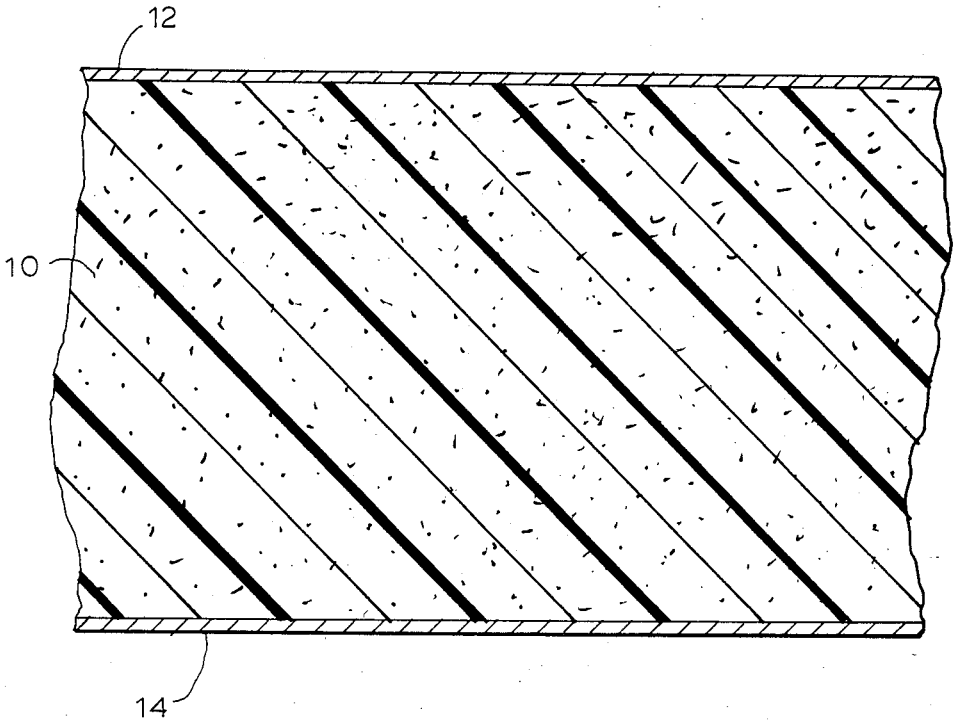
FIG. 3 is a cross-sectional view taken through the body of the cushion of the present invention prior to the application of the tufting stitches.
Figure 4:
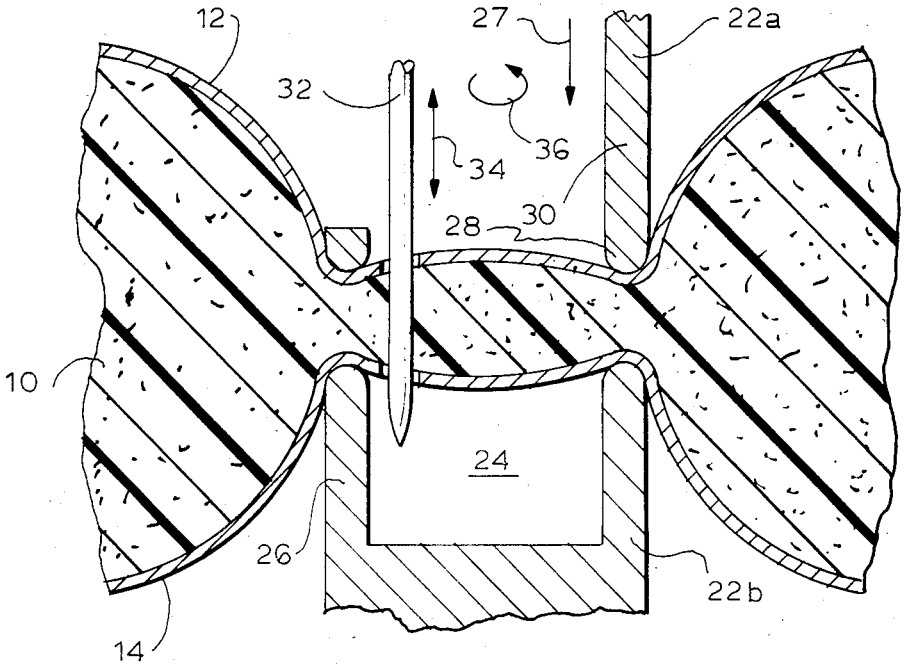
FIG. 4 is a cross-sectional view taken through the body of the cushion of the present invention illustating the apparatus utilized in order to create the simulated button tufting.

The method by which the simulated button tufting is achieved is illustrated in FIGS. 3 and 4. Prior to the stitching operation, foam body 10 is fully expanded, as illustrated in FIG. 3, such that the opposite surfaces thereof, as well as cover sheets 12 and 14 situated adjacent thereto, are in substantially parallel planes. The stitching operation is performed on a conventional sewing machine which is modified to include a compression member 22 formed of relatively movable mating parts *22a* *22b*.

As illustrated in FIG. 4, the cushion is placed on the machine such that the portion of the cushion to be stitched is aligned with part *22b*. Part *22b* preferably is generally cup-shaped having an upstanding cylindrical wall 26 which partially defines a recess 24.

Next, part *22a* is moved downwardly (as indicated by arrow 27) toward part *22b* compressing the portion of foam body 10 and the cover sheets 12, 14 aligned therewith between parts *22a* and *22b*. Part *22a* preferably comprises an annular bottom portion 28 adapted to align with the rim of wall 26 on part *22b*. The interior of annular portion 28 is open and preferably approximately the same diameter as recess 24 in part *22b*. Annular portion 28 is supported on a connecting member 30 which forms a portion of a manually driven or power driven linkage (not shown) utilized to lower and raise part *22a* with sufficient force to compress the portion of foam body 10 to be stitched and to temporarily maintain same in the compressed condition during the stitching operation.

Once the suitable portion of the cushion is aligned between parts 22*a* and 22*b* and part 22*a* has moved to a position proximate part 22*b* with the portion of the cushion compressed therebetween, a conventional sewing needle 32 is moved into position along the periphery of the opening in annular portion 28 such that it pierces cover sheet 12, a portion of foam body 10 which is compressed, and cover sheet 14. Neelde 32 is reciprocated in a vertical direction, as indicated by arrow 34 as it revolves in a circular pattern, as indicated by arrow 36, until the necessary circular pattern is achieved. Alternatively, needle 32 can be held in its original position and the cushion, along with parts 22*a* and 22*b*, can be rotated to achieve the desired circular stitch pattern.

It should be understood that while it is deemed desirable to create a circular pattern in order to simulate a button, patterns of other geometric shapes, such as ovals or rectangles, can easily be achieved by altering the shape of the opening in portion 28 of part 22*a* and guiding the stitching needle in the appropriate manner.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims.

I claim:

1. An article such as a cushion comprising a substantially solid compressible body having first and second surfaces, said body being substantially uninterrupted, having no openings therethrough, flexible sheet material situated along said surfaces to cover said body, a plurality of recessed areas spaced across the article, each of said recessed areas comprising a substantially closed stitch pattern defining the boundary of a substantially circular section of the article, each of said patterns comprising a plurality of stitches, said stitches passing through said body and aligned portions of said sheet material and maintaining the portion of said body within said circular section in a substantially compressed state, so as to simulate a tufted button effect.

2. The article of claim 1, wherein said first and second surfaces are opposing surfaces.

3. The article of claim 1, wherein said sheet material substantially encloses said body.

4. The article of claim 1, wherein said recessed areas are situated in a regular pattern.

5. The article of claim 1, wherein said recessed areas are uniformly spaced.

6. A method for simulating button tufting in an article such as a cushion of the type including a substantially solid compressible body covered on first and second surfaces by flexible sheet material, said body being substantially uninterrupted, having no openings therethrough, the method comprising the steps of: selecting a plurality of spaced areas on the article to form a regular pattern; compressing each area in turn by sandwiching the body and the sheet material covering the first and second surfaces thereof between first and second members; at least one of said members having an opening therein; applying a plurality of stitches along the boundary defined by the member opening in a substantially circular stitch pattern, the stitches passing through a portion of the compressed body and aligned portions of the sheet material covering the first and second surfaces and maintaining the portion of the body in a compressed state, so as to simulate button tufting.

* * * * *